US012559806B2

(12) United States Patent
Arvanitidis et al.

(10) Patent No.: US 12,559,806 B2
(45) Date of Patent: Feb. 24, 2026

(54) CEMENTED CARBIDE INSERT WITH ETA-PHASE CORE

(71) Applicant: SANDVIK MINING AND CONSTRUCTION TOOLS AB, Sandviken (SE)

(72) Inventors: Ioannis Arvanitidis, Vastberga (SE); Mirjam Lilja, Vastberga (SE)

(73) Assignee: Sandvik Mining and Construction Tools AB, Sandviken (SE)

( * ) Notice: Subject to any disclaimer, the term of this patent is extended or adjusted under 35 U.S.C. 154(b) by 0 days.

(21) Appl. No.: 18/570,104

(22) PCT Filed: Jun. 14, 2022

(86) PCT No.: PCT/EP2022/066236

§ 371 (c)(1),
(2) Date: Dec. 14, 2023

(87) PCT Pub. No.: WO2022/263477

PCT Pub. Date: Dec. 22, 2022

(65) Prior Publication Data

US 2025/0129442 A1 Apr. 24, 2025

(30) Foreign Application Priority Data

Jun. 16, 2021 (EP) ..... 21179812

(51) Int. Cl.
*C21D 1/06* (2006.01)
*C22C 29/08* (2006.01)
*E21C 35/183* (2006.01)

(52) U.S. Cl.
CPC ..... *C21D 1/06* (2013.01); *C22C 29/08* (2013.01); *E21C 35/1835* (2020.05)

(58) Field of Classification Search
CPC ..... E21C 35/1835; C21D 1/06; C22C 29/08; B22F 3/162; B22F 3/24; B22F 2005/001
See application file for complete search history.

(56) References Cited

U.S. PATENT DOCUMENTS 4,869,329 A * 9/1989 Kar ..... B23P 15/28 175/57
5,679,445 A * 10/1997 Massa ..... E21B 10/006 175/379

(Continued)

FOREIGN PATENT DOCUMENTS

EP 0182759 B2 12/1993
EP 3546608 A1 10/2019

(Continued)

OTHER PUBLICATIONS

Keown, Eugene Michel. "The effect of compressive residual stresses on the properties of tumbled-processed cemented carbide." PhD diss., University of Birmingham, 2017. (Year: 2017) (Year: 2017).*

*Primary Examiner* — Alexandra M Moore
(74) *Attorney, Agent, or Firm* — Corinne R. Gorski

(57) ABSTRACT

A method of treating a cemented carbide insert for rock drilling and mineral cutting is provided. The insert includes a core of cemented carbide and a surface zone of cemented carbide, wherein the core further contains eta-phase and the surface zone is free of eta-phase. The mining insert is subjected to a surface hardening process, wherein the surface hardening process is executed at an elevated temperature of or above 50° C.

10 Claims, 2 Drawing Sheets

(56) References Cited

U.S. PATENT DOCUMENTS

| | | | | |
|---|---|---|---|---|
| 7,188,993 | B1 * | 3/2007 | Howe | B06B 1/161 366/128 |
| 7,258,833 | B2 | 8/2007 | Rainey et al. | |
| 7,549,912 | B2 * | 6/2009 | Liang | B24B 31/104 175/426 |
| 8,657,894 | B2 * | 2/2014 | Pearce | C22C 47/14 51/307 |
| 8,720,613 | B2 * | 5/2014 | Carlsson | B24B 31/00 175/426 |
| 2010/0075122 | A1 * | 3/2010 | Reese | C21D 7/06 428/408 |
| 2019/0112679 | A1 | 4/2019 | Flasar | |

FOREIGN PATENT DOCUMENTS

| | | | | |
|---|---|---|---|---|
| EP | 3653743 | A1 | 5/2020 | |
| WO | WO-9707251 | A1 * | 2/1997 | C23C 26/00 |

* cited by examiner

CEMENTED CARBIDE INSERT WITH ETA-PHASE CORE

RELATED APPLICATION DATA

This application is a § 371 National Stage Application of PCT International Application No. PCT/EP2022/066236 filed Jun. 14, 2022 claiming priority to EP 21179812.9 filed Jun. 16, 2021.

TECHNICAL FIELD

The present invention is related to cemented carbide inserts for rock drilling, mineral cutting, oil drilling and in tools for concrete and asphalt milling.

BACKGROUND

Cemented carbide has a unique combination of high elastic modulus, high hardness, high compressive strength, high wear and abrasion resistance with a good level of toughness. Therefore, cemented carbide is commonly used in products such as mining tools.

EP0182759 discloses cemented carbide bodies comprising a core of cemented carbide containing eta-phase surrounded by a surface zone of cemented carbide free of eta-phase and having a low content of binder phase in the surface and a higher content of binder phase next to the eta-phase zone. The eta-phase core exhibits wear resistance and in combination with the binder phase gradient contributes to insert toughness. These inserts are highly wear resistant and resistant against the formation of premature cracking which would result in premature failure of the insert.

It is also known that cemented carbide mining inserts are commonly treated with an edge deburring and surface hardening process, such as tumbling, post sintering and centreless grinding. The surface hardening process introduces compressive stress into the mining inserts. The presence of the compressive stresses improves the fatigue resistance and fracture toughness of the mining insert. Consequently, the threshold energy necessary to fracture the mining insert is higher and so there is a reduced likelihood of chipping, cracking and/or fracture of the component.

However, inserts containing an eta-phase core surrounded by a surface zone of cemented carbide free of eta-phase and having a low content of binder phase in the surface and a higher content of binder phase next to the eta-phase zone are too brittle to be treated with a high energy surface hardening process which is capable of introducing higher levels of compressive stress. Whilst the increase in compressive stress maybe achieved from a high energy surface hardening process, the gain is counteracted by low yields due to a large proportion of the inserts chipping and having micro damage introduced during the treatment.

Therefore, it is desirable to be able to provide a cemented carbide insert having the combined benefit of the eta phase core with improved component for improved fracture toughness with a method that does not result in high levels of chipping.

SUMMARY OF INVENTION

Thus, the present disclosure provides a method of treating a cemented carbide insert for rock drilling and mineral cutting comprising a core of cemented carbide and a surface zone of cemented carbide surrounding said core, wherein both the surface zone and the core contain WC (alpha-phase) with a binder phase (beta-phase) based upon at least one of cobalt, nickel or iron, and wherein the core further contains eta-phase and the surface zone is free of eta-phase, wherein the inner part of the surface zone being situated next to the core has a content of binder phase being greater than the nominal content of the binder phase in the cemented carbide body and the content of the binder phase increases gradually in the surface zone in the direction towards the core up to at least 1.2 times compared to the nominal content of the binder phase of the cemented carbide body, characterized in that said mining insert is subjected to a surface hardening process wherein the surface hardening process is executed at an elevated temperature of or above 50° C., preferably at a temperature of or above 100° C., preferably at a temperature of or above 200° C., more preferably at a temperature of between 200° C. and 450° C.

Advantageously, by performing the surface hardening treatment at elevated temperature inserts are able to be produced having improved fracture toughness without the issues of high percentages of chipped inserts, where the chipping often occurs in regions with high stress concentrations, such as transition zones between cylinder and dome as well as transition zones in the bottom of the inserts, which would compromise production yields. Using the present method higher levels of compressive stresses are introduced into the cemented carbide mining insert. An elevated tumbling temperature results in increased toughness of the carbide and hence the collisions do not result in defects such as micro cracks, large surface cracks or edge chipping. The higher level of compressive stress in combination with decreased collision defects will improve the fatigue resistance and fracture toughness of the insert and consequently increase the lifetime of the insert. Further advantages of this method are that insert geometries, such as those with a sharp bottom radius, which were previously prone to excessive damage to the corners and therefore low yields, can now be tumbled without causing edge damage. This opens the possibility to develop insert products with different geometries, which were previously not suitable for tumbling. The method also makes it possible to use cemented carbide compositions that would have previously been too brittle for mining applications or for high energy tumbling processes as described in U.S. Pat. No. 7,258,833B2, Epiroc Smith, for example. The ability to introduce higher levels of compressive stress means that the toughness of the mining inserts is increased to an acceptable level and thus mining inserts having a higher hardness can be used which is beneficial for increasing the wear resistance and hence the overall performance of the inserts.

Another aspect of the present disclosure is a cemented carbide insert for rock drilling and mineral cutting comprising a core of cemented carbide and a surface zone of cemented carbide surrounding said core, wherein both the surface zone and the core contain WC (alpha-phase) with a binder phase (beta-phase) based upon at least one of cobalt, nickel or iron, and wherein the core further contains eta-phase and the surface zone is free of eta-phase, wherein the inner part of the surface zone being situated next to the core has a content of binder phase being greater than the nominal content of the binder phase in the cemented carbide body and the content of the binder phase increases gradually in the surface zone in the direction towards the core up to at least 1.2 times compared to the nominal content of the binder phase of the cemented carbide body, having a profile hardness, HV3p, measured 0.3 mm from the surface along the top, non-cylindrical part of the insert and an eta-phase core hardness, HV3η, which an average of the HV3 hardness measurements taken in the core eta phase region, characterized in that $HV3_p-HV3_\eta>20$, preferably $HV3_p-HV3_\eta>30$, more preferably $HV3_p-HV3_\eta>40$, even more preferably >50.

Advantageously, these inserts have high fracture strength and improved operational performance with reduced premature insert chipping that would previously have caused failures.

Another aspect of the present disclosure is a cemented carbide insert for rock drilling and mineral cutting produced according to the method as disclosed hereabove or hereinafter.

DETAILED DESCRIPTION

Figure 1:
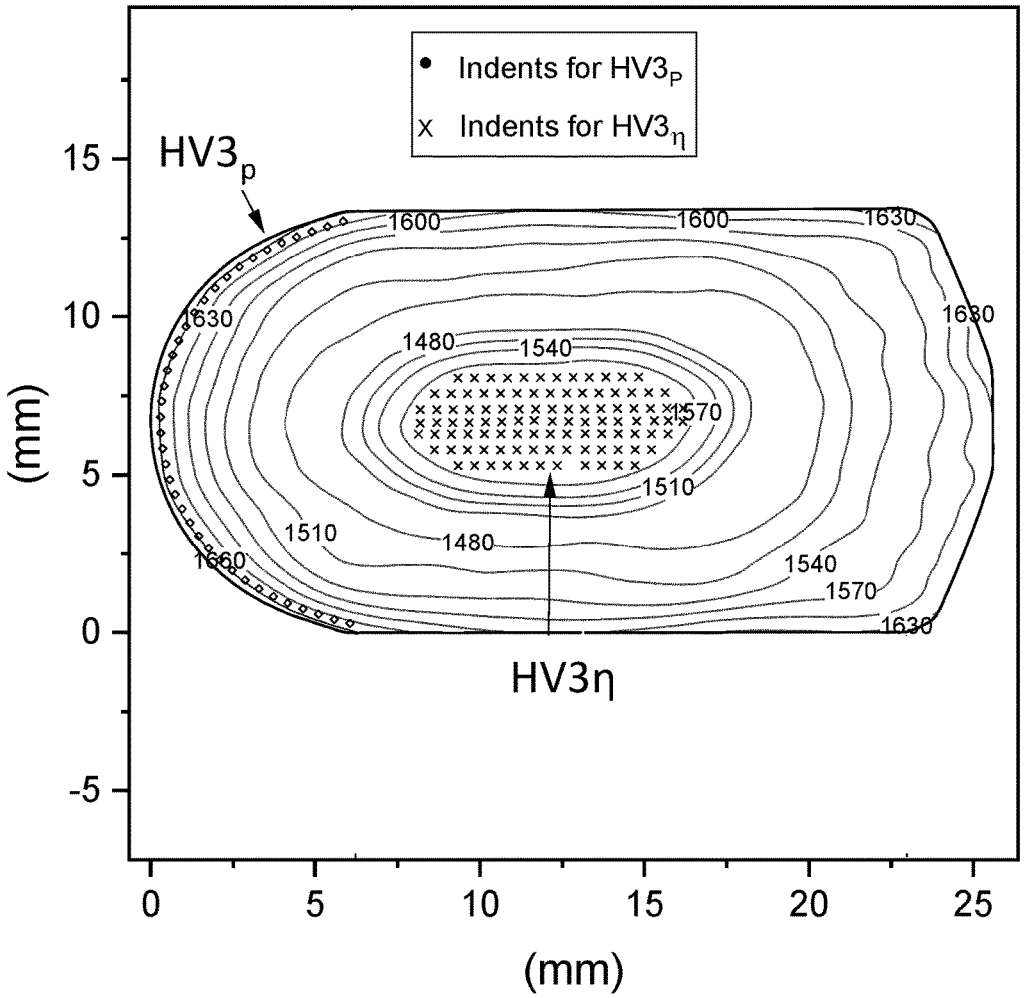
FIG. 1: Plot showing locations of the $HV3_p$ and $HV3_\eta$ indentations.

Cemented carbide bodies of the present invention have a region with finely and uniformly distributed eta-phase embedded in the normal alpha+beta-phase structure created in the centre of said bodies. At the same time, the bodies have a surrounding surface zone with only alpha+beta-phase. With eta-phase we mean low-carbon phases of the W—C—Co-system such as the $M_6C$- and $M_{12}C$-carbides and kappa-phase with the approximate formula $M_4C$. The surface zone is completely free of eta-phase. The zone free of eta-phase can for example be made by addition of carbon at high temperature to cemented carbide bodies having eta-phase throughout. By varying time and temperature, a zone free of eta-phase with desired thickness can be obtained.

By "cemented carbide" is herein meant a material that comprises at least 50 wt % WC, possibly other hard constituents common in the art of making cemented carbides and a metallic binder phase preferably selected from one or more of Fe, Co and Ni. In one embodiment of the method, the cemented carbide mining insert contains a hard phase comprising at least 80 wt % WC, preferably at least 90 wt %.

The metallic binder of the cemented carbide can comprise other elements that are dissolved in the metallic binder during sintering, such as W and C originating from the WC. Depending on what other types of hard constituents that are present, also other elements can be dissolved in the binder.

A surface hardening treatment is defined as any treatment that introduces compressive stresses into the material through physical impacts, that results in deformation hardening at and below the surface, for example tumbling or shot peening. The surface hardening treatment is done post sintering and grinding. It has unexpectedly been found, that treating a mining insert with a surface hardening treatment at elevated temperatures decreases or even eliminates the carbide to carbide collision damages in terms of chipping and micro fracturing and therefore improving product lifetime. The surface hardening process of the present invention is performed at an elevated temperature, and this temperature is herein defined as the temperature of the mining insert at the start of the surface hardening process. The upper limit for the temperature, where the surface hardening process is performed, is preferably below the sintering temperature, more preferably below 900° C. The temperature of the mining insert is measured by any method suitable for measuring temperature, such as an infrared temperature measurement.

In one embodiment of the present invention the mining insert is subjected to a surface hardening treatment at a temperature of between 150-250° C., preferably at a temperature of between 175-225° C.

In one embodiment of the present invention the upper limit for the surface hardening treatment is 700° C., preferably 600° C., more preferably 550° C.

In one embodiment of the present invention the mining insert is subjected to a surface hardening treatment at a temperature of between 300-600° C., preferably at a temperature of between 350-550° C., more preferably of between 450-550° C.

The temperature is measured on the mining insert using any suitable method for measuring temperature. Preferably, an infrared temperature measurement device is used.

In one embodiment the cemented carbide comprises hard constituents in a metallic binder phase, and wherein the metallic binder phase content in the cemented is 4 to 30 wt %, preferably 5 to 15 wt %. The binder phase content needs to be high enough to provide a tough behaviour of the mining insert. The metallic binder phase content is preferably not higher than 30 wt %, preferably not higher than 15 wt %. A too high content of binder phase reduces the hardness and wear resistance of the mining insert. The metallic binder phase content is preferably greater than 4 wt %, more preferably greater than 6 wt %.

In one embodiment the metallic binder phase comprises at least 80 wt % of one or more metallic elements selected from Co, Ni and Fe. Preferably Co and/or Ni, most preferably Co, even more preferably between 3 to 20 wt % Co. Optionally, the binder is a nickel chromium or nickel aluminium alloy. The carbide mining insert may optionally also comprise a grain refiner compound in an amount of ≤20 wt % of the binder content. The grain refiner compound is suitably selected from the group of carbides, mixed carbides, carbonitrides or nitrides of vanadium, chromium, tantalum and niobium. With the remainder of the carbide mining insert being made up of the one or more hard-phase components.

In one embodiment the cemented carbide additionally comprises Cr, in an amount such that the mass ratio of Cr/binder is of 0.043-0.19, preferably between 0.075-0.15, more preferably between 0.085-0.12.

The mass ratio of the Cr/binder is calculated by dividing the weight percentage (wt %) of the Cr added to powder blend by the wt % of the binder in the powder blend, wherein the weight percentages are based on the weight of that component compared to the total weight of the powder blend. To a great extent the Cr is dissolved into the binder phase, however there could be some amount, e.g. up to 3 mass %, of undissolved chromium carbide in the cemented carbide body. It may however be preferable to only add Cr up to the mass ratio of Cr/binder so that all the Cr dissolved into the binder so that the sintered cemented carbide body is free of undissolved chromium carbides. If the mass ratio of Cr/binder is too low, the positive effects of the Cr will be too small. If, on the other hand, the mass ratio of the Cr/binder is too high, there will be an increased formation in the concentration of chromium carbides, in which the binder will dissolve, thereby reducing the volume of the binder phase and consequently making the cemented carbide body too brittle. The present invention enables the possibility to increase the Cr content before embrittlement becomes an issue.

The Cr is normally added to the powder blend in the form of $Cr_3C_2$ as this provides the highest proportion of Cr per gram of powder, although it should be understood that the Cr could be added to the powder blend using an alternative chromium carbide such as $Cr_{26}C_2$ or $Cr_7C_3$ or a chromium nitride.

The addition of the Cr also has the effect of improving the corrosion resistance of the cemented carbide body. The presence of the Cr also makes the binder prone to transform from fcc to hcp during drilling, this is beneficial for absorbing some of the energy generated in the drilling operation. The transformation will thereby harden the binder phase and reduce the wear of the button during use thereof. The presence of the Cr will increase the wear resistance of the cemented carbide and increase its ability for deformation hardening.

Apart from the hard-phase forming component, the binder and Cr containing component, incidental impurities may be present in the WC-based starting material.

In one embodiment the content of binder phase in the surface zone increases towards the core to 1.4-2.5 times the nominal content of the binder phase.

In one embodiment the grain size of the eta-phase is 0.5-10 μm.

In one embodiment the content of eta-phase in the core is 2-60% by volume.

In one embodiment the width of the eta-phase core is 10-95% of the diameter of the body.

In one embodiment the width of the outermost zone having a lower binder phase content is 0.2-0.8 of the width of the zone free of eta-phase.

In one embodiment the method includes a step of heating the mining inserts and media prior to the surface hardening process and the surface hardening process is performed on heated mining inserts.

The mining insert can be heated in a separate step prior to the surface hardening process step. Several methods can be used to create the elevated temperature of the mining insert, such as induction heating, resistance heating, hot air heating, flame heating, pre-heating on a hot surface, in an oven or furnace or using laser heating.

In an alternative embodiment, the mining inserts are kept heated during the surface hardening process. For examples using an induction coil.

In one embodiment the surface hardening process is tumbling. The tumbling treatment could be centrifugal or vibrational. A "standard" tumbling process would typically be done using a vibrational tumbler, such as a Reni Cirillo RC 650, where about 30 kg inserts would be tumbled at about 50 Hz for about 40 minutes. An alternative typical "standard" tumbling process would be using a centrifugal tumbler such as the ERBA-120 having a closed lid at the top and has a rotating disc at the bottom. One more method is the centrifugal barrel finishing process. In both centrifugal processes, the rotation causes the inserts to collide with other inserts or with any media added. For "standard" tumbling using a centrifugal tumbler the tumbling operation would typically be run from 120 RPM for at least 20 minutes. The lining of the tumbler may form oxide or metal deposits onto the surface of the inserts.

By the term "bulk" is herein meant the innermost part (centre) of the cutting tool and for this disclosure is the zone having the lowest hardness.

To introduce higher levels of compressive stresses into the cemented carbide mining insert, a high energy tumbling (HET) process may be used. There are many different possible process setups that could be used to introduce HET, including the type of tumbler, the volume of media added (if any), the treatment time and the process set up, e.g. RPM for a centrifugal tumbler etc. Therefore, the most appropriate way to define HET is in terms of "any process set up that introduces a specific degree of deformation hardening in a homogenous cemented carbide mining insert consisting of WC—Co, having a mass of about 20 g". In the present disclosure, HET is defined as a tumbling treatment that would introduce a hardness change, measured using HV3, after tumbling (ΔHV3%) of at least:

$$\Delta HV3\% = 9.72 - 0.00543 * HV3_{bulk} \quad \text{(equation 1)}$$

Wherein:

$$\Delta HV3\% = 100 * (HV3_{0.3\,mm} - HV3_{bulk})/HV3_{bulk} \quad \text{(equation 2)}$$

$HV3_{bulk}$ is an average of at least 30 indentation points measured in the innermost (centre) of the cemented carbide mining insert and $HV3_{0.3\ mm}$ is an average of at least 30 indentation points at 0.3 mm below the tumbled surface of the cemented carbide mining insert. This is based on the measurements being made on a cemented carbide mining insert having homogenous properties. By "homogeneous properties" we mean that post sintering the hardness different is no more than 1% from the surface zone to the bulk zone. The tumbling parameters used to achieve the deformation hardening described in equations (1) and (2) on a homogenous cemented carbide mining insert would be applied to cemented carbide bodies having a gradient property.

HET tumbling may typically be performed using an ERBA 120, having a disc size of about 600 mm, run at about 150 RPM if the tumbling operation is either performed without media or with media that is larger in size than the inserts being tumbled, or at about 200 RPM if the media used is smaller in size than the inserts being tumbled; Using a Rösler FKS04 tumbler, having a disc size of about 350 mm, at about 200 RPM if the tumbling operation is either performed without media or with media that is larger in size than the inserts being tumbled, or at about 280 RPM if the media used is smaller in size than the inserts being tumbled. Typically, the parts are tumbled for at least 40-60 minutes.

In one embodiment after the mining inserts have been subjected to the surface hardening process at an elevated temperature, the mining inserts are subjected to a second surface hardening process at room temperature. Advantageously, this removes debris and oxides, for example iron oxide, that are deposited on the insert surfaces from the inside of the process container. The second surface hardening process performed at room temperature could be performed in wet conditions, which will aid in removing dirt and dust from the mining inserts being treated which reduces health hazards. The second surface hardening treatment could be high energy tumbling.

It may be necessary to modify the lining of the tumbler to be able to withstand the higher elevated temperatures that the process is conducted at.

In one embodiment the surface hardening process is conducted in dry conditions.

In one embodiment all or part of the heat is generated by the friction between the inserts and any media added in the tumbling process.

In one embodiment, $HV3_{\eta}$ is at least 1450 HV3, preferably at least 1460 HV3, more preferably at least 1470 HV3, more preferably >1490 HV3, more preferably >1500 HV3.

$HV3_{\eta}$ is considered to be the hardness in the eta phase core and is the equivalent to the bulk of the insert.

The hardness measurements are performed using a programmable hardness tester, KB30S by KB Prüftechnik GmbH calibrated against HV1, HV3, HV20, HV30 and HV100 test blocks issued by Euro Products Calibration Laboratory, UK. Hardness is measured according to ISO EN6507-01.

HV3 measurements were done in the following way:

Scanning the edge of the sample.

Programming the hardness tester to make indentations at specified distances from the edge of the sample.

Indentation with 3 kg load at all programmed co-ordinates.

The computer moves the stage to each co-ordinate, locates the microscope over each indentation, and runs auto adjust light, auto focus and the automatically measures the size of each indentation.

The user inspects all the photos of the indentations for focus and other matters that disturb the result.

In one embodiment of the present invention, the cemented carbide is not coated.

EXAMPLES

Example 1—Starting Materials and Tumbling Conditions

Mining inserts with the following (as sintered) compositions have been tested:

TABLE 1

Composition of mining inserts tested.

| Sample | WC (wt %) | Co (wt %) | Com/Co | Surface hardening treatment |
|---|---|---|---|---|
| A (comparative) | 94.5 | 5.5 | 0.92 | Standard centrifugal tumbling |
| B (comparative) | 94.5 | 5.5 | 0.94 | 25° C. wet HET |
| C (invention) | 94.5 | 5.5 | 0.94 | 300° C. dry shake + 25° C. wet shake |
| D (invention) | 94.5 | 5.5 | 0.94 | 300° C. dry shake + 300 RPM centrifugal tumbling |

All cemented carbide inserts were produced using a WC powder grain size measured as FSSS was before milling between 5 and 18 μm. The WC and Co powders were milled in a ball mill in wet conditions, using ethanol, with an addition of 2 wt % polyethylene glycol (PEG 8000) as organic binder (pressing agent) and cemented carbide milling bodies. After milling, the mixture was spray-dried in $N_2$-atmosphere and then uniaxially pressed into mining inserts having a size of about 18 mm in outer diameter (OD) and about 32 mm in height with a weight of approximately 54 g each with a spherical dome ("cutting edge") on the top for sample A, C and D. Sample B inserts had a 10 mm OD. The inserts were then pre-sintered in $N_2$ gas and then thermally treated in a carburizing atmosphere. Post sintering the samples had an eta-phase content of about 4 wt % in the eta-phase core. An example of the sintering method is further detailed in EP0182759.

Comparative samples A were wet tumbled at room temperature with in a standard centrifugal tumbler (i.e. low energy, not HET). Comparative samples B were tumbled at room temperature using HET.

For the inventive samples C and D in order to replicate HET at an elevated temperature on a lab scale a "hot shaking" method has been used. The hot shaking method uses a commercially available paint shaker of trademark Corob™ Simple Shake 90 with a maximum load of 40 kg and a maximum shaking frequency of 65 Hz. The "hot shaking" method was conducted in batches of 20 mining inserts at a frequency of 45 Hz. About 1000 grams or 50 pieces of inserts and 4.0 kg carbide media (1490 pieces of about 7 mm balls) where placed in a cylindrical steel container with inner diameter of 10 cm and inner height of 12 cm filling it up to ⅔ of the height. The steel cylinder with the mining insert were heated with media in a furnace to an elevated temperature of 300° C., the mining inserts were held at the target temperature for 120 minutes. After heating, the steel cylinder was transferred straight into the paint shaker and immediately shook for 9 minutes. The transfer time between the furnace until the shaker started was less than 20 seconds. The media was made of the cemented carbide grade H10F having 10 wt % Co, 0.5 wt % Cr and 89.5 wt % WC that results in sintered HV20 of about 1600. In the tables of results samples treated according to this method are referred to as "300° C. dry shake" where the shaking was performed in dry conditions, i.e. no water was added to the shaking. Both the inventive cases (C and D) were then subjected into a second tumbling step in wet conditions at room temperature but with different tumbling intensities. The second tumbling step for sample C was using the same conditions as for the hot shaking method described above with the exceptions of no heating step or furnace step at all prior shaking and that 100 ml water was added to the steel cylinder prior tumbling in order to have a wet very intense tumbling effect close to room temperature. The second tumbling step for sample D was done using a standard centrifugal tumbler, Rasler FKS04, with a disc size of 350 mm, at 300 RPM (near maximum RPM) for 50 minutes in wet conditions.

The temperatures stated for the surface hardening treatments are starting temperatures. For the batches treated with a starting temperature of 25° C., if water is added to the process, the temperature is not expected to significantly increase as the samples are treated.

Example 2—Edge Damage

It is important that the damage to the edges of the mining inserts is low, preferably none at all, post tumbling in order to have the highest yields.

A batch of 20 mining inserts of each sample type were inspected visually for damages post tumbling for to compare the yields of good quality mining inserts if the surface hardening treatment is done at room temperature vs higher temperature. The mining insert was counted as having damage if the chipping was greater than about 1 mm in length or if the chipping reached out to the centreless ground cylindrical surface of the insert. The percentage of damaged inserts reported in table 2:

TABLE 2

Percentage of mining inserts being damaged post shaking treatment.

| Sample | Percentage of damaged inserts |
|---|---|
| A (comparative) | 3% |
| B (comparative) | 99% |
| C (inventive) | 5% |
| D (inventive) | 5% |

The results in table 2 show that there is a reduction in the amount of edge damage to the mining inserts if the surface hardening treatment is conducted at an elevated temperature. The results in table 2 show that the percentage of edge damage for sample B inserts was extremely high and therefore not a process that could feasibly be used in production, whereas for the inventive samples C and D, the yields are comparable to those achieved when standard centrifugal tumbling is used.

Example 3—Insert Compression Test

The insert compression test method involves compressing a drill bit insert between two plane-parallel hard counter surfaces, at a constant displacement rate, until the failure of the insert. A test fixture based on the ISO 4506:2017 (E) standard "Hardmetals—Compression test" was used, with cemented carbide anvils of hardness exceeding 2000 HV, while the test method itself was adapted to toughness testing of rock drill inserts. The fixture was fitted onto an Instron 5989 test frame.

The loading axis was identical with the axis of rotational symmetry of the inserts. The counter surfaces of the fixture fulfilled the degree of parallelism required in the ISO 4506:2017 (E) standard, i.e. a maximum deviation of 0.5 μm/mm. The tested inserts were loaded at a constant rate of crosshead displacement equal to 0.6 mm/min until failure, while recording the load-displacement curve. The compliance of the test rig and test fixture was subtracted from the measured load-displacement curve before test evaluation. Five inserts were tested per sample type. The counter surfaces were inspected for damage before each test. Insert failure was defined to take place when the measured load suddenly dropped by at least 1000 N. Subsequent inspection of tested inserts confirmed that this in all cases this coincided with the occurrence of a macroscopically visible crack. The material toughness was characterized by means of the total absorbed deformation energy until fracture. The summary fracture energy, in Joules (J), required to crush the samples is shown in table 3 below:

TABLE 3

Fracture energy (J) required to crush the samples

| Sample | Fracture energy (J) |
|---|---|
| A (comparative) | 13.1 |
| C (inventive) | 29.0 |
| D (inventive) | 23.7 |

Table 3 shows that considerably higher fracture toughness is achieved from inventive samples C and D.

Example 4—Hardness Measurements

HV3 hardness was measured on a polished cross sectioned inserts at depths of 0.3, 0.8, 1.3, 1.8. 2.3, 2.8, 3.3, 3.8, 4.3, 4.8, 5.3, 5.8, 6.3 and 6.8 mm below the edge. FIG. 1 shows the positions of the hardness indentations and hardness measurements for sample C. The profile hardness, HV3p, is an average of the HV3 hardness measurement taken at 0.3 mm below the tumbled surface across the top, non-cylindrical part of the insert as indicated on FIG. 1. The η-phase core hardness, HV3η, is an average of the HV3 hardness measurements taken in the core eta phase region, as indicated on FIG. 1. Table 4 shows a summary of average HV3η measurements and shows that HV3p−HV3η is greater for the inventive samples.

TABLE 4

Hardness difference between profile hardness and core hardness.

| Sample | HV3η | HV3p (measured at 0.3 mm below dome) − HV3η (measured in the η-phase core) |
|---|---|---|
| A (comparative) | 1572 | 1 |
| C (inventive) | 1577 | 87 |
| D (inventive) | 1553 | 48 |

Figure 2:
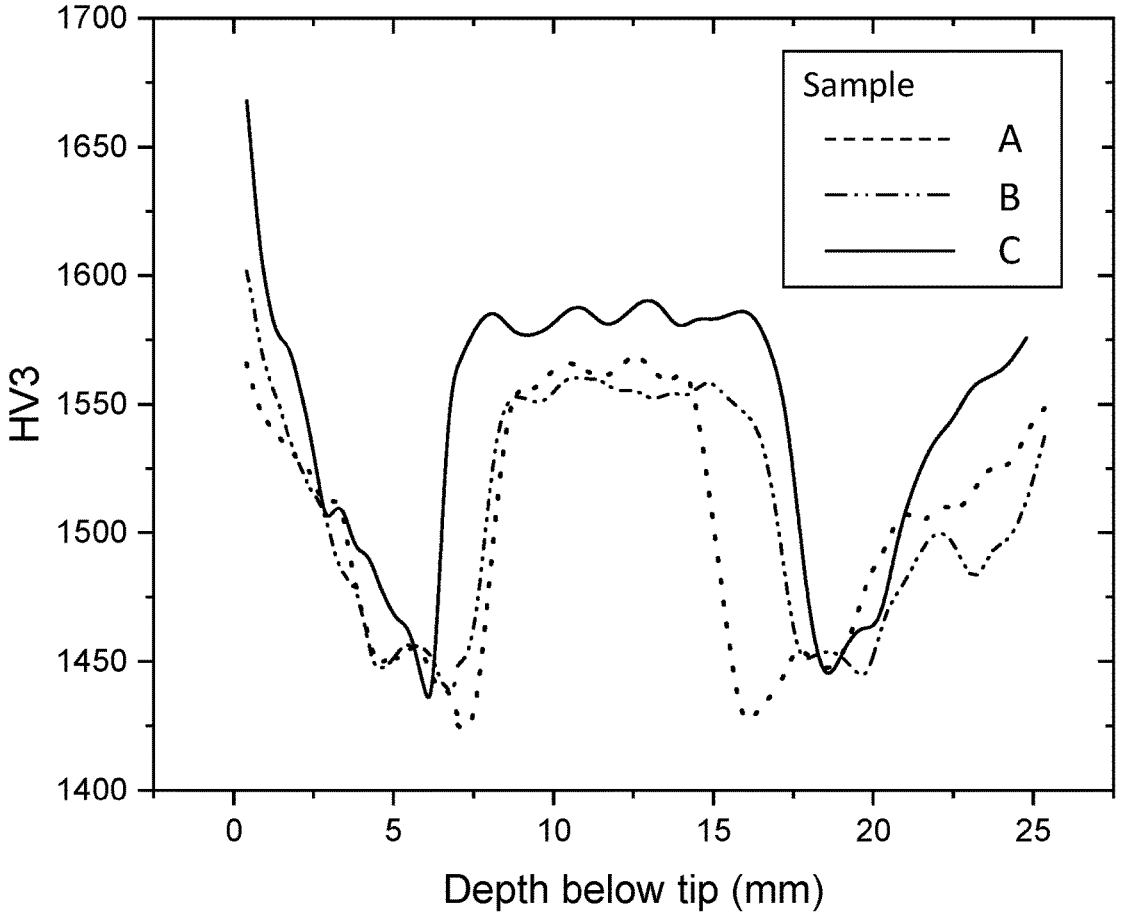
FIG. 2: HV3 hardness profiles.

FIG. 2 shows HV3 profile through the center of the inserts from tip to bottom by using the software Origin from OriginLab Corporation.

Example 4—Field Trial

Down the hole (DTH) rock drill bits Ø229 mm with 18 mm DP65™ inserts were tested where the inserts were treated either with cold, wet high energy tumbling (sample B-comparative samples) or dry, hot high energy tumbling at 300° C. (sample C-inventive samples). The tumbling for both sets of inserts was done in the same equipment having same conditions such as tumbling intensity and tumbling time. The comparative samples were tumbled according to the industry standard using about 5 kg of carbide inserts and 100 ml water based grinding liquid in a steel tumbling drum. The inventive samples were tumbled by preheating about 5 kg carbide inserts including the tumbling steel drum to 300° C. followed by the high energy tumbling directly afterwards by placing the filled hot tumbling drum into the tumbler.

Each DTH bit was configured with 12 inserts having a height of 32.5 mm and a mass of 108 g in the outermost gage insert row and 17 inserts having a height of 27.5 mm and a mass of 89 g in the remaining front.

The bits were tested on rock that consists mostly of diorite and dolerite where the compressive strength of the rock ranges from 280-350 MPA. Dolerite is harder than diorite so this normally results in many insert failures especially at the gage row which is the weakest point in rock drill bits. An improvement in gage insert strength would result in an improved tool life in terms of drilled meters.

Eight comparative samples and nine inventive samples were tested. The results are shown in table 5 below.

TABLE 5

Summary field trial results

| Cold, wet tumbled samples (comparative) | Meters drilled | Gage inserts lost | Hot, dry tumbled samples (inventive) | Meters drilled | Gage inserts lost |
|---|---|---|---|---|---|
| Bit 1 | 468 | 6 | Bit 1 | 693 | 6 |
| Bit 2 | 559 | 4 | Bit 2 | 455 | 8 |

TABLE 5-continued

| Summary field trial results | | | | | |
|---|---|---|---|---|---|
| Cold, wet tumbled samples (comparative) | Meters drilled | Gage inserts lost | Hot, dry tumbled samples (inventive) | Meters drilled | Gage inserts lost |
| Bit 3 | 362 | 12 | Bit 3 | 401 | 5 |
| Bit 4 | 593 | 9 | Bit 4 | 547 | 9 |
| Bit 5 | 469 | 7 | Bit 5 | 550 | 5 |
| Bit 6 | 476 | 7 | Bit 6 | 748 | 8 |
| Bit 7 | 413 | 8 | Bit 7 | 547 | 5 |
| Bit 8 | 517 | 7 | Bit 8 | 672 | 2 |
| — | — | — | Bit 9 | 402 | 5 |
| Average | 482 | 7.5 | Average | 557 | 5.9 |

It can be seen that the average bit life increases from 482 m to 557 m, which is a 16% increase in drill life and that the average number gage insert failures drops from 7.5 to 5.9, which is a 21% reduction.

The invention claimed is:

1. A method of treating a cemented carbide insert for rock drilling and mineral cutting, the insert comprising a core of cemented carbide and a surface zone of cemented carbide surrounding said core, wherein both the surface zone and the core contains WC with a binder phase based upon at least one of cobalt, nickel or iron, and wherein the core further contains eta-phase and the surface zone is free of eta-phase, wherein an inner part of the surface zone situated next to the core has a content of binder phase being greater than a nominal content of the binder phase in the cemented carbide body and the content of the binder phase increases gradually in the surface zone in a direction towards the core up to at least 1.2 times compared to the nominal content of the binder phase of the cemented carbide body, wherein the method comprises:

subjecting the insert to a surface hardening process;

heating the insert to a temperature of or above 50° C. prior to the surface hardening process; and executing the surface hardening process at an elevated temperature of 50° C. to 450° C., wherein the surface hardening is tumbling.

2. The method according to claim 1, wherein the cemented carbide comprises hard constituents in a metallic binder phase, and wherein the metallic binder phase content in the cemented carbide is 3 to 30 wt %.

3. The method according to claim 2, wherein the metallic binder phase comprises at least 80 wt % of one or more metallic elements selected from Co, Ni and Fe.

4. The method according to claim 1, wherein the cemented carbide further comprises Cr, in an amount such that a mass ratio of Cr/binder is of 0.043-0.19.

5. The method according to claim 1, wherein the content of binder phase in the surface zone increases towards the core to 1.4-2.5 times the nominal content of the binder phase.

6. The method according to claim 1, wherein the insert is tumbled with media and wherein the media is also heated prior to and during tumbling to a temperature of 50° C. or above.

7. The method according to claim 1, wherein the insert is kept heated during the surface hardening process.

8. The method according to claim 1, wherein after the insert has been subjected to the surface hardening process at an elevated temperature, the insert is subjected to a second surface hardening process at room temperature.

9. The method according to claim 1, wherein the tumbling process is a High Energy Tumbling process, wherein post tumbling a homogenous cemented carbide mining insert is deformation hardened such that $\Delta HV3\% \geq 9.72 - 0.00543 * HV3_{bulk}$, wherein the ΔHV3% is the percentage difference between the HV3 measurement at 0.3 mm from the surface compared the HV3 measurement in the bulk.

10. The method according to claim 1, wherein the surface hardening process is conducted in dry conditions.

* * * * *